US007413078B2

(12) United States Patent
Fischer et al.

(10) Patent No.: US 7,413,078 B2
(45) Date of Patent: Aug. 19, 2008

(54) DISPENSER FOR RAZOR CARTRIDGES

(75) Inventors: Stephan Fischer, Gevelsberg (DE); Jochen Thoene, Wuppertal (DE)

(73) Assignee: Eveready Battery Company, Inc., St. Louis, MO (US)

( * ) Notice: Subject to any disclaimer, the term of this patent is extended or adjusted under 35 U.S.C. 154(b) by 236 days.

(21) Appl. No.: 11/396,802

(22) Filed: Apr. 3, 2006

(65) Prior Publication Data

US 2006/0219584 A1 Oct. 5, 2006

Related U.S. Application Data

(60) Provisional application No. 60/668,825, filed on Apr. 5, 2005.

(51) Int. Cl.
*A45C 11/26* (2006.01)

(52) U.S. Cl. ..... 206/354; 206/477

(58) Field of Classification Search ..... 206/354, 206/355, 356, 357, 358, 359, 360, 477, 478, 206/480, 486, 488
See application file for complete search history.

(56) References Cited

U.S. PATENT DOCUMENTS 4,742,909 A * 5/1988 Apprille et al. ..... 206/356
5,636,442 A * 6/1997 Wain ..... 30/40.2
6,041,926 A * 3/2000 Petricca et al. ..... 206/356

FOREIGN PATENT DOCUMENTS

| | | |
|---|---|---|
| EP | 0 969 952 B1 | 3/2003 |
| GB | 2 091 154 A | 7/1982 |
| GB | 2 245 859 A | 1/1992 |

OTHER PUBLICATIONS

International Search Report dated Jul. 27, 2006.

* cited by examiner

*Primary Examiner*—Jacob K Ackun, Jr.
(74) *Attorney, Agent, or Firm*—Michaud-Duffy Group LLP

(57) ABSTRACT

According to one aspect of the present invention, a dispenser for one or more razor cartridges includes a base, two side walls, a front wall, a rear wall, a first divider, a second divider, a cover, and a side spring. The first divider is located between the front wall and the rear wall. The second divider is located between the first divider and the front wall, forming a chamber between the second divider and the first divider. The chamber is sized and shaped to receive at least a portion of a razor cartridge. The cover extends partially over the chamber between the first divider and second divider, and is sized to provide an opening through which the razor cartridge can be inserted into the chamber. The side spring extends widthwise into the chamber. The cover and the side spring frictionally engage the razor cartridge when inserted into the chamber.

12 Claims, 4 Drawing Sheets

DISPENSER FOR RAZOR CARTRIDGES

CROSS REFERENCE TO RELATED APPLICATIONS

This application is entitled to the benefit of and incorporates by reference the disclosure of U.S. patent application Ser. No. 60/668,825 filed on Apr. 5, 2005 entitled "Dispenser for Razor Cartridges."

BACKGROUND OF THE INVENTION

1. Field of the Invention

The present invention relates generally to dispensers, and, more particularly, to a dispenser for razor cartridges.

2. Description of the Prior Art

Modern shaving implements often include a plurality of blades disposed within a razor cartridge. The razor cartridge is, in turn, mounted on a handle during use. Some safety razors have a disposable razor cartridge that is removably mounted on a reusable handle while others have a handle and a razor cartridge that are manufactured as a single, disposable unit.

In those shaving implements utilizing a disposable razor cartridge, several razor cartridges are typically sold together in groups of, for example, four (4). There is typically provided a dispenser that selectively holds one or more razor cartridges before and/or after the user has attached the razor cartridge to the handle for use.

Dispensers have been known to have various shortcomings, including, but not limited to, expense in manufacturing and assembly and razor cartridges unintentionally falling out of the dispenser.

It is, therefore, an object of the present invention to overcome the known shortcomings of the prior art.

SUMMARY OF THE DISCLOSURE

According to one aspect of the present invention, a dispenser for one or more razor cartridges includes a base, two side walls, a front wall, a rear wall, a first divider, a second divider, a cover, and a side spring. The base has a length and width. The two side walls run generally lengthwise along and extend upwards from the base. The front and rear walls each run generally widthwise along and extend upward from the base and between the two side walls. The first divider is located between the front wall and the rear wall and extends at least part way between the two side walls. The second divider is located between the first divider and the front wall and extends at least part way between the two side walls, forming a chamber between the second divider and the first divider. The chamber is sized and shaped to receive at least a portion of a razor cartridge. The cover extends partially over the chamber between the first divider and second divider, and is sized to provide an opening through which the razor cartridge can be inserted into the chamber. The side spring extends widthwise into the chamber. The cover and the side spring frictionally engage the razor cartridge when inserted into the chamber.

According to one embodiment of the present invention, at least one chamber includes two side springs, wherein a side spring extends widthwise into at least one chamber. The side springs cooperate to frictionally engage the razor cartridge when inserted into the chamber.

According another embodiment of the present invention, the first divider and the rear wall cooperate to form a chamber therebetween that is sized and shaped to receive at least a portion of a razor cartridge.

According to a further embodiment of the present invention, the dispenser described above can include a forward divider. The forward divider can be located between the second divider and the front wall. The forward divider is operable to create additional chamber(s) for the insertion of razor cartridges.

According to an even further embodiment of the present invention, the dispenser described above can include a rearward divider. The rearward divider can be located between the second divider and the front wall. The rearward divider is operable to create additional chamber(s) for the insertion of razor cartridges.

One advantage of the present invention is that when a razor cartridge is inserted into a cavity, the side spring(s) and the cover frictionally engage the razor cartridge to prevent it from undesirably exiting the dispenser.

Another advantage of the present invention is that the dispenser is operable to securely store multiple razor cartridges.

These and other advantages of the present invention will be apparent to one of skill in the art in light of the Detailed Description and Drawings.

DETAILED DESCRIPTION

Figure 1:
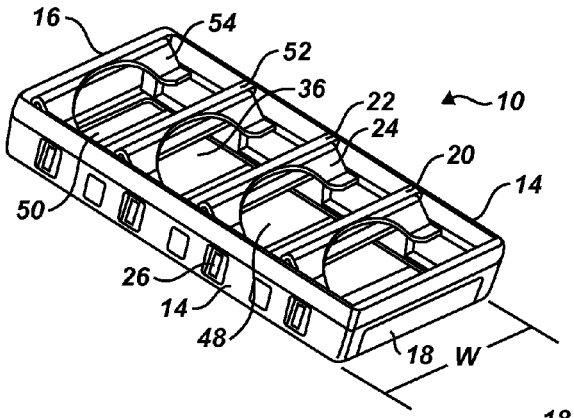
FIG. 1 is a perspective view of one embodiment of the dispenser of the present invention
Figure 2:
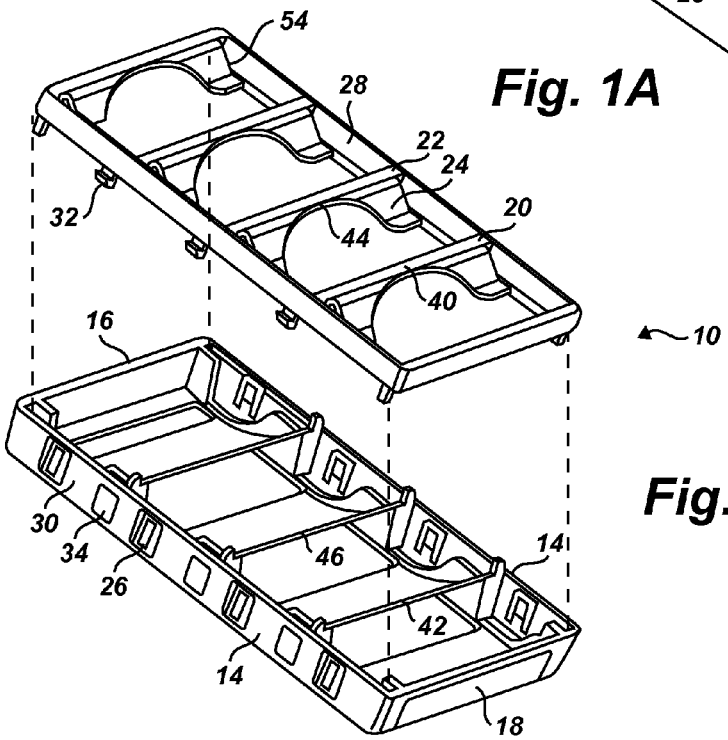
FIG. 2 is an exploded view of the dispenser of FIG. 1.

Referring to FIGS. 1-2, the dispenser of the present invention is generally identified by the number 10. The dispenser 10 includes a base 12, two side walls 14, a front wall 16, and a rear wall 18. The dispenser 10 further includes a first divider 20, a second divider 22, a cover 24, and at least one side spring 26.

The base 12 defines a length (L) and a width (W). The base 12 may be substantially flat, or, as shown in FIG. 2, the base 12 may be contoured. The two side walls 14 run generally lengthwise along and extend upwards from the base 12. The front and rear walls 14,16 each run generally widthwise along and extend upward from the base 12 and between the two side walls 14.

In some embodiments, as shown for example in FIG. 2, the dispenser 10 may include an upper dispenser portion 28 and a lower dispenser portion 30. In other embodiments, however, the dispenser 10 may be formed of a single, unitary piece. In the former embodiments, the upper and lower dispenser portions 28,30 can be connected for use in any suitable manner. For example, in embodiments where the dispenser 10 is made of a polymeric material, the two dispenser portions 28,30 may be ultrasonically welded together. Alternatively, the upper dispenser portion 28 and the lower dispenser portion 30 may include complimentary connecting members 32,34 that are operable to attach the two dispenser portions 28,30. For example, as shown in FIG. 2, the upper dispenser portion 28 and the lower dispenser portion 30 snap together to form a single dispenser 10. In most embodiments, it is preferable that the upper and lower dispenser portions 28,30 are not separable during normal use.

Figure 3:
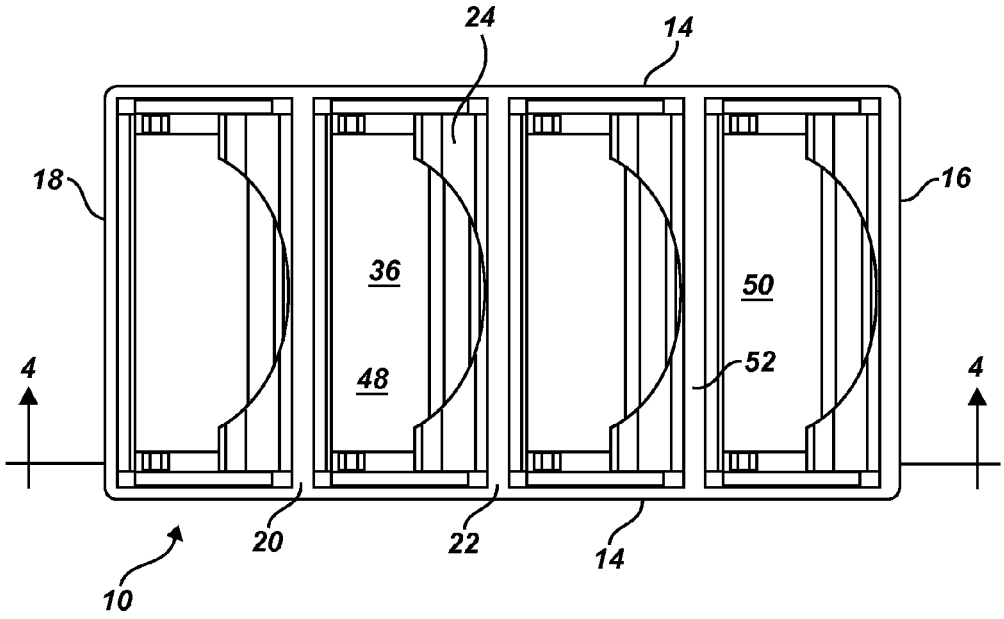
FIG. 3 is top view of the dispenser of FIG. 1.
Figure 4:
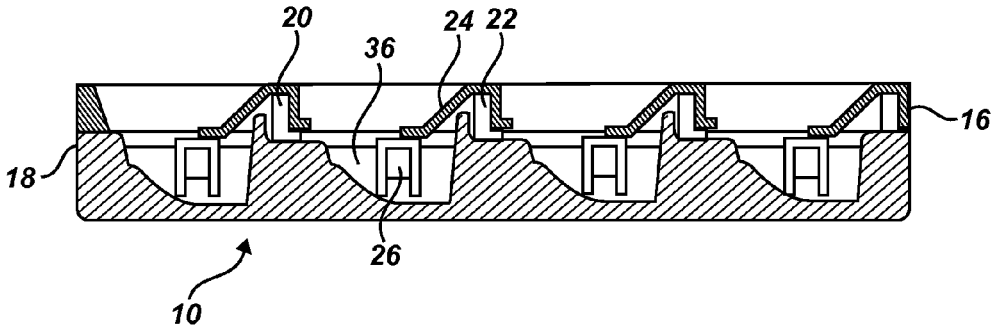
FIG. 4 a sectional view of the dispenser of FIG. 3 along line 4-4.

Referring to FIGS. 1-3, the first divider 20 is located between the front wall 16 and the rear wall 18 and extends at least part way between the two side walls 14. Preferably, at least a portion of the first divider 20 extends across the entire width of the base 12, from side wall 14 to side wall 14, as shown in FIG. 3. The second divider 22 is located between the first divider 20 and the front wall 16 and extends at least part way between the two side walls 14. Together, the first and second dividers 20,22 form a chamber 36 therebetween that is sized and shaped to receive at least a portion of a razor cartridge 38. Preferably, as shown in FIG. 4, the first and second dividers 20,22 are contoured to compliment the shape of the razor cartridge 38 that is to be inserted in the chamber 36. Even more preferably, the first and second dividers 20,22 are shaped such that neither is in contact with the blades (not visible) of the razor cartridge 38 that is inserted into the chamber 36.

In some embodiments, the first and second dividers 20,22 may each comprise an upper portion and lower portions. In other words, the first divider 20 may include an upper first divider 40 and a lower first divider 42, and the second divider 22 may include an upper second divider 44 and a lower second divider 46. For example, in the embodiment where the dispenser 10 includes an upper dispenser portion 28 and a lower dispenser portion 38 (described supra and shown in FIG. 2), the upper first divider 40 and upper second divider 44 can be part of the upper dispenser portion 28, and the lower first divider 42 and the lower second divider 46 can be part of the lower dispenser portion 30.

The cover 24 extends partially over the chamber 36 between the first divider 20 and second divider 22, the cover 24 being sized to provide an opening 48 through which a razor cartridge 38 can be selectively passed for insertion into the chamber 36. In some embodiments, such as the one shown in FIG. 1, the cover 24 is attached to the first divider 20 and extends over the chamber 36 in a direction toward the rear wall 18. Alternatively, although not shown, the cover can be attached to the second divider 22 and extend over the chamber 36 in a direction toward the front wall 16. In another alternative, the cover 24 can be attached to one or more of the side walls 14 and extend widthwise over chamber 36. In an even further alternative, in instances where there is a front chamber 50 formed by the front wall 16 and a forward divider 52 (discussed infra), a front cover 54 can be integral with the front wall 16 (see e.g. FIG. 1). The above examples, however, are only exemplary in nature, and the present invention should not be considered to be limited to the examples provided. Preferably, as shown for example in FIG. 2, the cover 24 is cantilevered over the chamber 36 or front chamber 54 such that, when a razor cartridge 38 is inserted in the chamber 36, the cover 24 is deflected, creating a frictional engagement between the cover 24 the razor cartridge 38.

Figure 1A:
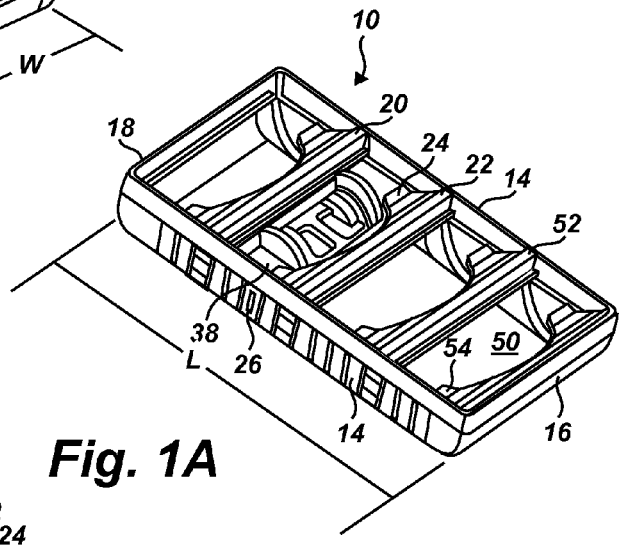
FIG. 1A is a perspective view of the dispenser of FIG. 1 with a cartridge therein.
Figure 5:
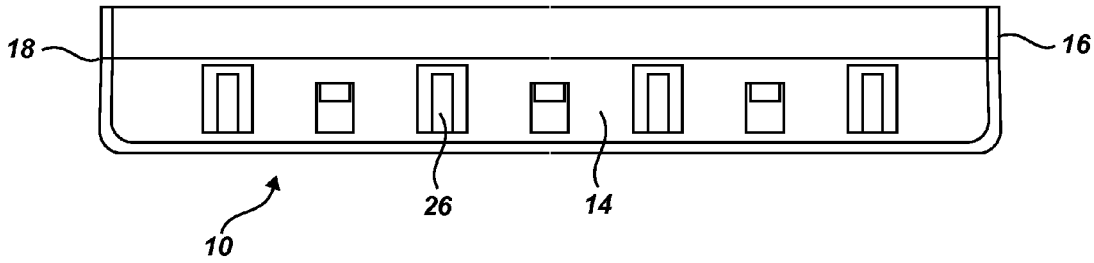
FIG. 5 is a side view of the dispenser of FIG. 1.

Referring now to FIG. 5, at least one side spring 26 extends widthwise into the chamber 36. In some embodiments, the side spring 26 is attached to one of the two side walls 14, while, in other embodiments, the side spring 26 is attached to the base 12. Preferably, at least two side springs 26 extend into the chamber 36, with at least one side spring 26 being attached to each of the two side walls 14. In embodiments having opposing side springs 26, such as is shown in FIG. 1A, the razor cartridge 38 is frictionally engaged between the at least two side springs 26. Like the cover 24, it is preferable that the side spring 26 is cantilevered widthwise into the chamber 36 such that, when the cartridge 38 is inserted in the chamber 36, the side spring 26 is deflected, creating a frictional engagement between the cover 24 and the razor cartridge 38. However, although not shown, the side spring 26 does not need to be cantilevered. Alternatively, the side spring 26 can be, for example, a leaf spring.

In another embodiment of the present invention, the dispenser 10 can include a forward divider 52 that is similar in structure to the first and second dividers 20,22, described above. The forward divider 52 can be located between the second divider 22 and the front wall 11, as shown in FIG. 1. In these instances, a chamber 36 for the insertion of razor cartridges 38 can be formed between the forward divider 52 and/or a front chamber 50 for the insertion of razor cartridges 38 can be formed between the forward divider 50 and the front wall 16. Each of the additional chambers 36,50, as shown in FIG. 6, can also include a cover 24 and/or side spring(s) 26 similar to those described above.

Figure 6:
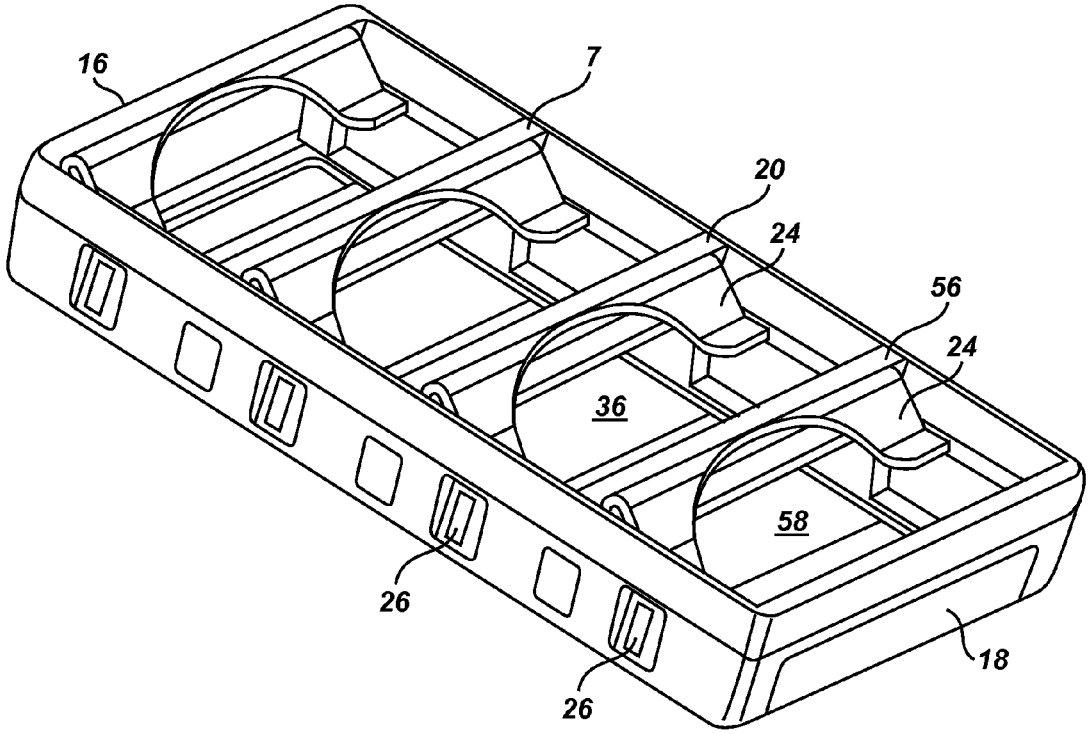
FIG. 6 is a perspective view of one embodiment of the dispenser of the present invention.

In other instances, a rearward divider 56 can be located between the first divider 20 and the rear wall 18, as shown in FIG. 6. In these instances, chamber(s) 36 for the insertion of razor cartridges can be formed between the rearward divider 50 and the first divider 20 and/or the rearward divider 50 and the rear wall 18 (i.e., forming a rear chamber 58). Each of the additional chambers 36,58, as shown in FIG. 6, can also include a cover 24 and/or side spring(s) 26 similar to those described above.

In further embodiments of the present invention, in addition to a forward and/or rearward divider(s) 52,56, the dispenser 10 can further include additional dividers (not shown) between the first divider 20 and the rearward divider 56 and/or between the second divider 22 and the forward divider 52 for the creation of more chambers. Each of the additional chambers (not shown) can also include a cover and/or side spring (s), similar to cover 24 and side springs 26 described above. The number of additional dividers added to the dispenser 10 is typically driven by the number of razor cartridges 38 it is desired to store in the dispenser 10.

The dispenser 10 is typically made from a single type of material, preferably a molded polymeric material. However, the dispenser 10 may be made from any suitable material, including, for example, metal.

In use, and now referring to all FIGS, one or more razor cartridges 38 is inserted into a chamber in the dispenser 10. Upon insertion, the razor cartridge 38 deflects the cover and at least one side spring, creating a frictional engagement between the razor cartridge and both the cover and side spring (s). The frictional engagement maintains the razor cartridge (s) in the dispenser 10 until a user selectively removes the razor cartridge from the dispenser 10.

Modification and variations may be made to the disclosed embodiments without departing from the subject and spirit of the invention as defined by the following claims.

What is claimed is:

1. A dispenser, comprising:

a base having a length and a width, two side walls, a front wall and a rear wall, the two side walls running generally lengthwise along and extending upwards from the base, and the front and the rear walls each running generally widthwise along and extending upward from the base and between the two side walls;

a first divider is located between the front wall and the rear wall and extending at least part way between the two side walls;

a second divider is located between the first divider and the front wall and extending at least part way between the two side walls forming a chamber between the second divider and the first divider, the chamber being sized and shaped to receive at least a portion of a razor cartridge;

a cover that extends partially over the chamber between the first divider and second divider, the cover being sized to provide an opening through which the razor cartridge can be selectively passed for insertion into the chamber; and at least one side spring extending widthwise into the chamber;

wherein the cover and the side spring frictionally engage the razor cartridge when inserted into the chamber.

2. The dispenser of claim 1, further comprising a forward divider between the second divider and the front wall.

3. The dispenser of claim 2, wherein the forward divider forms a front chamber sized and shaped to receive a cartridge between the front wall and the forward divider.

4. The dispenser of claim 3, wherein a front cover partially covers the front chamber, the front cover being integral with the front wall.

5. The dispenser of claim 1, further comprising a rearward divider between the first divider and the rear wall.

6. The dispenser of claim 1, wherein the cover is integral with the first divider.

7. The dispenser of claim 6, wherein the cover is cantilevered over a portion of the chamber such that the cover is deflected when the razor cartridge is inserted into the chamber.

8. The dispenser of claim 1, wherein the first divider is comprised of an upper divider and a lower divider.

9. The dispenser of claim 1, wherein the side spring is attached to one of the two side walls.

10. The dispenser of claim 9, wherein the side spring is cantilevered widthwise into the chamber such that the side spring is deflected when the razor cartridge is inserted into the chamber.

11. The dispenser of claim 1, wherein at least two side springs extend into the chamber, with at least one side spring being attached to each of the two side walls.

12. The dispenser of claim 11, wherein the razor cartridge is frictionally engaged between the at least two side springs.

* * * * *